US007951024B2

(12) United States Patent
Mizek

(10) Patent No.: US 7,951,024 B2
(45) Date of Patent: May 31, 2011

(54) BLADE-OPENING ARROWHEAD

(75) Inventor: Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 670 days.

(21) Appl. No.: 11/981,133

(22) Filed: Oct. 31, 2007

(65) Prior Publication Data

US 2009/0111621 A1 Apr. 30, 2009

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS

| | | | | | |
|---|---|---|---|---|---|
| 2,993,697 | A | * | 7/1961 | Urban | 473/583 |
| 4,006,901 | A | | 2/1977 | Simo | |
| 4,093,230 | A | | 6/1978 | Simo | |
| 4,175,749 | A | | 11/1979 | Simo | |
| 4,203,601 | A | | 5/1980 | Simo | |
| 4,381,866 | A | | 5/1983 | Simo | |
| 4,579,348 | A | * | 4/1986 | Jones | 473/583 |
| 4,676,512 | A | | 6/1987 | Simo | |
| 4,973,060 | A | * | 11/1990 | Herzing | 473/583 |
| 4,976,443 | A | * | 12/1990 | DeLucia | 473/583 |
| 5,082,292 | A | * | 1/1992 | Puckett et al. | 473/583 |
| 5,100,143 | A | * | 3/1992 | Puckett | 473/583 |
| 5,871,410 | A | | 2/1999 | Simo et al. | |
| 6,200,237 | B1 | * | 3/2001 | Barrie | 473/583 |
| 6,270,435 | B1 | * | 8/2001 | Sodaro | 473/583 |
| 6,398,676 | B1 | | 6/2002 | Mizek | |
| 6,669,586 | B2 | * | 12/2003 | Barrie et al. | 473/583 |
| 7,025,697 | B2 | | 4/2006 | Mizek et al. | |
| 7,037,222 | B2 | | 5/2006 | Mizek et al. | |
| 7,226,375 | B1 | * | 6/2007 | Sanford | 473/583 |
| 7,232,390 | B2 | | 6/2007 | Mizek et al. | |
| 7,677,995 | B1 | * | 3/2010 | Sanford | 473/583 |
| 2007/0161438 | A1 | | 7/2007 | Fulton | |

OTHER PUBLICATIONS http://www.smokebroadheads.com/products.htm, Smoke Broadheads, Internet Listing Products Page, p. 1 of 2, 2008.

Co-pending U.S. Appl. No. 12/069,729, filed Feb. 12, 2008, title Blade Opening Broadhead.

* cited by examiner

*Primary Examiner* — John Ricci

(74) *Attorney, Agent, or Firm* — Pauley Petersen & Erickson

(57) ABSTRACT

A blade-opening arrowhead or broadhead that has one or more blades each pivotally or otherwise movably mounted with respect to a body or a ferrule. Each blade is moveable between a closed position and an open position, for example to increase a cutting diameter of the arrowhead. An actuator or an activation arm can be used to operate a cam surface. The blade can move as a follower element in response to movement of the cam surface. In the open position, the cam surface can contact the blade.

15 Claims, 4 Drawing Sheets

BLADE-OPENING ARROWHEAD

BACKGROUND OF THE INVENTION

1. Field of the Invention

This invention relates to a mechanical arrowhead or broadhead that uses a cam surface to move a blade from a closed position to an open position.

2. Discussion of Related Art

Mechanical arrowheads or broadheads that have blades which move from a closed position to an open position are known. In many conventional mechanical arrowheads, blades move from a closed position or flight position to an open position or cutting position.

In some conventional mechanical arrowheads, blades are maintained in a closed position or a flight position by retaining members, such as spring elements, O-rings and retaining bands.

In some conventional mechanical arrowheads, blades responsively move from a closed position to an open position by applying a force to an actuating element.

SUMMARY OF THE INVENTION

It is one object of this invention to provide a mechanical arrowhead that uses an activation element or an actuation element to move a blade from a closed position or a flight position to an open position or a cutting position.

The above and other objects of this invention can be accomplished with a mechanical arrowhead or broadhead that has an actuator which moves a cam surface between the closed position and the open position. For at least a portion of blade movement between the closed position and the open position, the cam surface contacts the blade. For example, a blunt surface, such as a back portion of the blade, can contact the cam surface and act as a follower element to move the blade in response to movement of the cam surface.

The cam surface can be fixed with respect to an actuation arm, can be integrated with an actuation arm and/or can be mechanically driven by any other suitable mechanical device which translates a forced movement of an actuating element into responsive movement of the cam surface, such as with respect to the blade and/or the arrowhead.

In some embodiments of this invention, the actuation arm can have a blunt surface and/or a sharpened surface to form a cutting edge on the blade. When the actuation arm has a cutting edge or a sharpened surface, the actuation arm can act as a cutting blade and thereby increase a cutting or penetrating capability of the arrowhead.

During flight, the arrowhead of this invention can be used to position each blade and/or each actuation arm relatively close to a body or a ferrule of the arrowhead, to improve flight characteristics of the overall arrowhead.

As the arrowhead impacts or approaches a target surface, in some embodiments of this invention, each activation arm contacts the target surface which forces and moves each activation arm away from the body or ferrule. In some embodiments of this invention, movement of the activation arm causes a cam surface to move with respect to the body or ferrule. Any suitable actuator that translates an input force to an output movement of the cam and/or the cam surface can be used to operate or actuate the blade from the closed position to the open position.

Moving the blade from the closed position to the open position can increase a cutting diameter of the arrowhead. The shape and/or size of each blade and/or of each actuation arm can be selected or designed to achieve any desired cutting diameter.

BRIEF DESCRIPTION OF THE DRAWINGS

The drawings show different features of an archery arrowhead according to preferred embodiments of this invention, wherein.

DETAILED DESCRIPTION OF THE INVENTION

Many features of the blade-opening arrowhead of this invention are similar to features taught by Mizek, U.S. Pat. No. 6,398,676, the entire teachings of which are incorporated by reference into this specification. Many elements taught by this invention can be interchanged with elements taught by U.S. Pat. No. 6,398,676.

Figure 1:
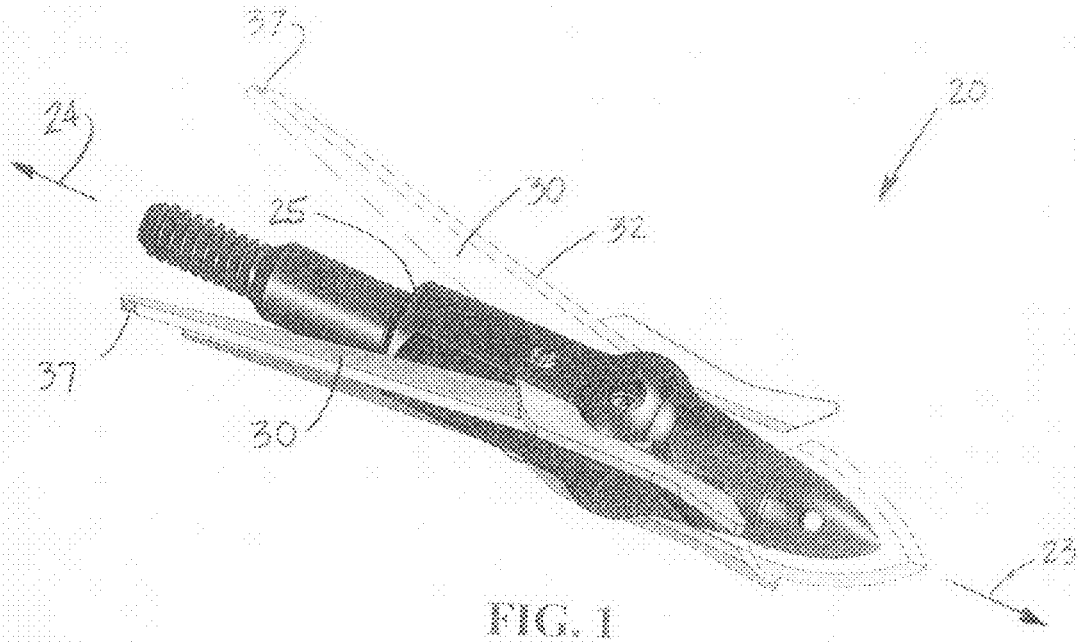
FIG. 1 is a perspective view of an arrowhead having mechanical blades in a closed position, according to one embodiment of this invention.
Figure 2:
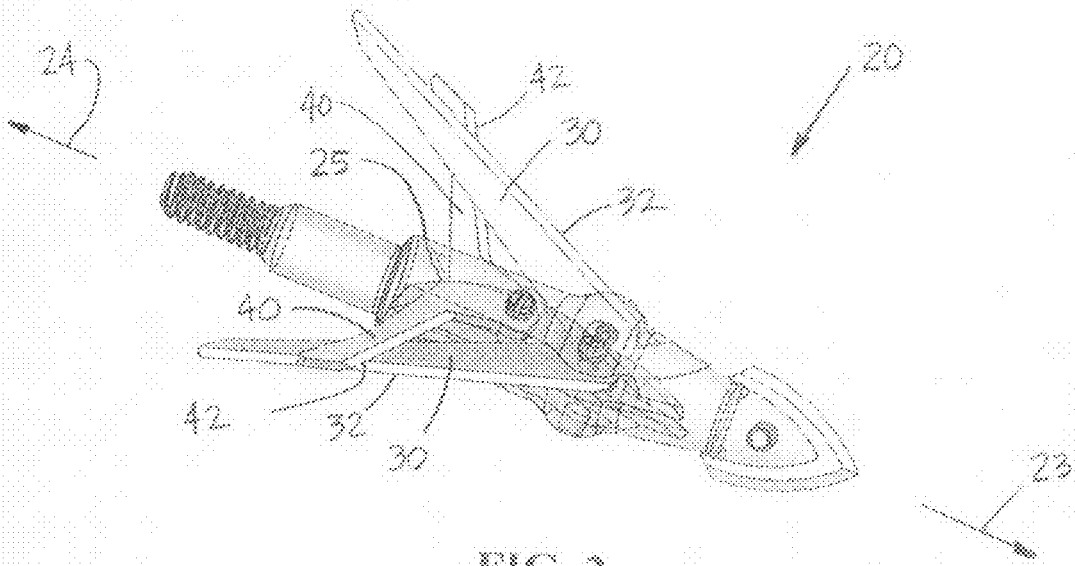
FIG. 2 is a perspective view of the arrowhead as shown in FIG. 1, but in an open position.

FIG. 1 shows broadhead or arrowhead 20 in a closed position or a flight position, and FIG. 2 shows arrowhead 20 in an open position or a penetrating position, according to one embodiment of this invention. As used throughout this specification and in the claims, the terms the closed position and the flight position are intended to be interchangeable with each other. As used throughout this specification and in the claims, the terms open position and penetrating position are intended to be interchangeable with each other.

Figure 3:
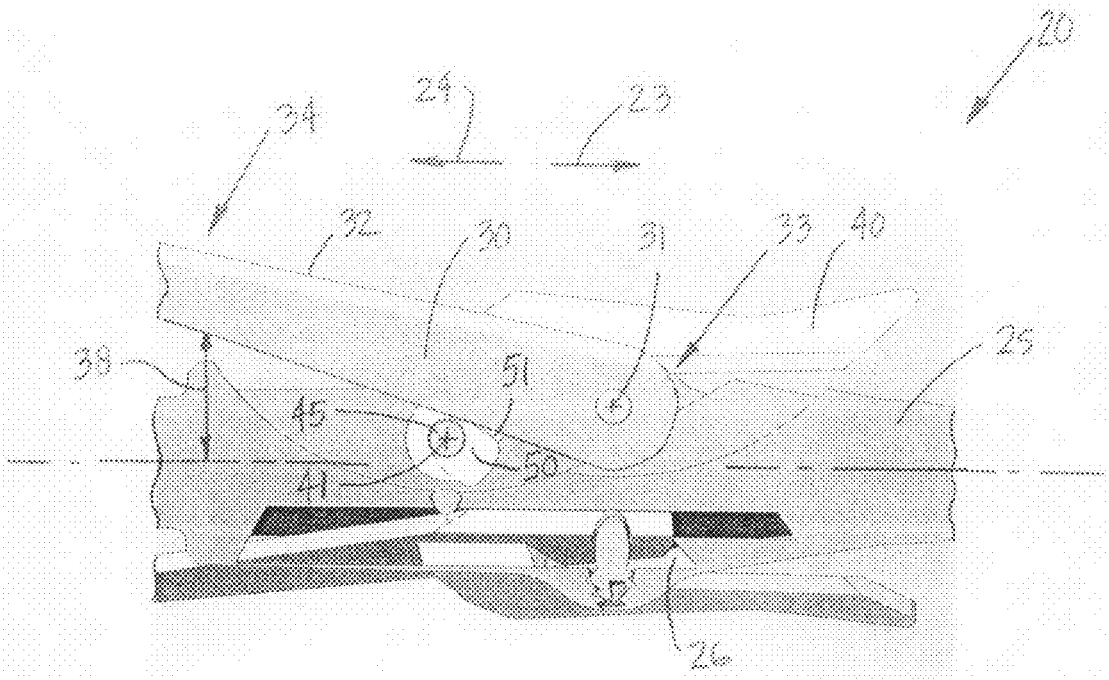
FIG. 3 is a partial sectional view of an arrowhead in a closed position, according to one embodiment of this invention.

FIG. 3 shows arrowhead 20 in the closed position. Arrowhead 20 of this invention can be attached directly to or with respect to any suitable conventional arrow shaft, using any suitable connector or connection device known to those skilled in the art of archery. During flight of an arrow shaft and arrowhead combination, significant aerodynamic in-flight characteristics can be enhanced or can benefit from tucking or positioning blades relatively close to a blade-carrying body, such as body 25 shown in FIG. 3. Upon impact of a target, arrowhead 20 can move from the closed position shown in FIG. 3 to the open position shown in FIG. 4. As arrowhead 20 moves from the closed position to the open position, at least one blade 30 moves in a direction that increases an overall cutting radius of arrowhead 20. The increased cutting radius can result in arrowhead 20 cutting more target material, such as animal tissue, as arrowhead 20 penetrates into the target.

As shown in FIGS. 1-4, at least one blade 30 is pivotally mounted with respect to body 25. One or more blades 30 can each pivot or otherwise move between the closed position and the open position. In the embodiment shown in FIGS. 3 and 4, actuation arm 40 is pivotally mounted with respect to body 25. In some embodiments of this invention, cam surface 51 is fixed with respect to actuation arm 40, so that when actuation arm 40 pivots or otherwise moves, cam surface 51 correspondingly or responsively pivots or otherwise moves along with actuation arm 40. Any other suitable mechanical element and/or combination of elements can be used, for example to mechanically, magnetically and/or electrically move cam surface 51 with respect to body 25.

Figure 4:
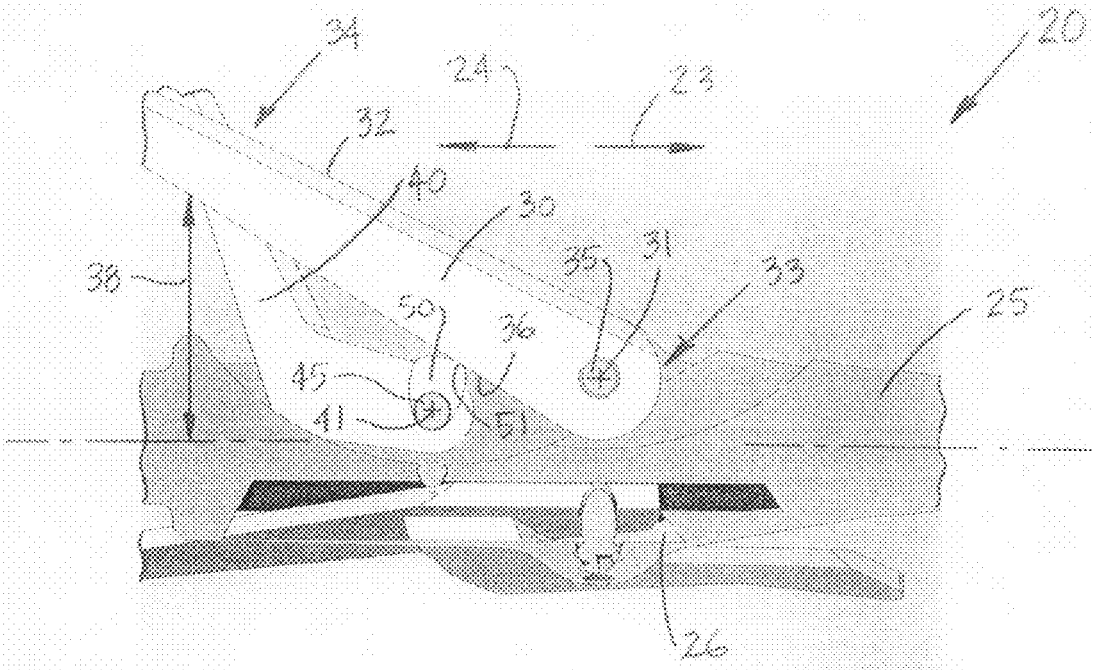
FIG. 4 is a partial sectional view of the arrowhead as shown in FIG. 3, but in an open position.

As shown between FIGS. 3 and 4, cam 50 moves between the closed position and the open position. During at least a portion of the movement of cam 50, cam surface 51 contacts or engages with blade 30. In certain embodiments of this invention, blade 30 acts as a follower, a following element or any other suitable device that moves in response to movement of cam 50. Cam 50 and/or cam surface 51 can be designed and/or sized to accomplish many different movements, continuous, non-continuous or intermittent, of blade 30 in response to movement of actuation arm 40.

In some embodiments according to this invention, another suitable actuator or actuating device can be used to move blade 30 in response to movement caused by the actuator or actuating device. For example, a pusher mechanically coupled to a moveable tip structure, a plunger device, a magnetic device, an electrical device and/or any other suitable mechanical device can be used to move cam surface 51 with respect to blade 30. The actuator or actuating device can be designed to cause movement of cam surface 51 simultaneous with, soon before and/or soon after impact with or contact between arrowhead 20 and a corresponding target. Actuation arm 40 or another suitable actuator and/or cam 50 can be sized and/or designed to move blade 30 slower or faster, through any suitable movement path, depending upon the intended use of arrowhead 20.

Figure 6:
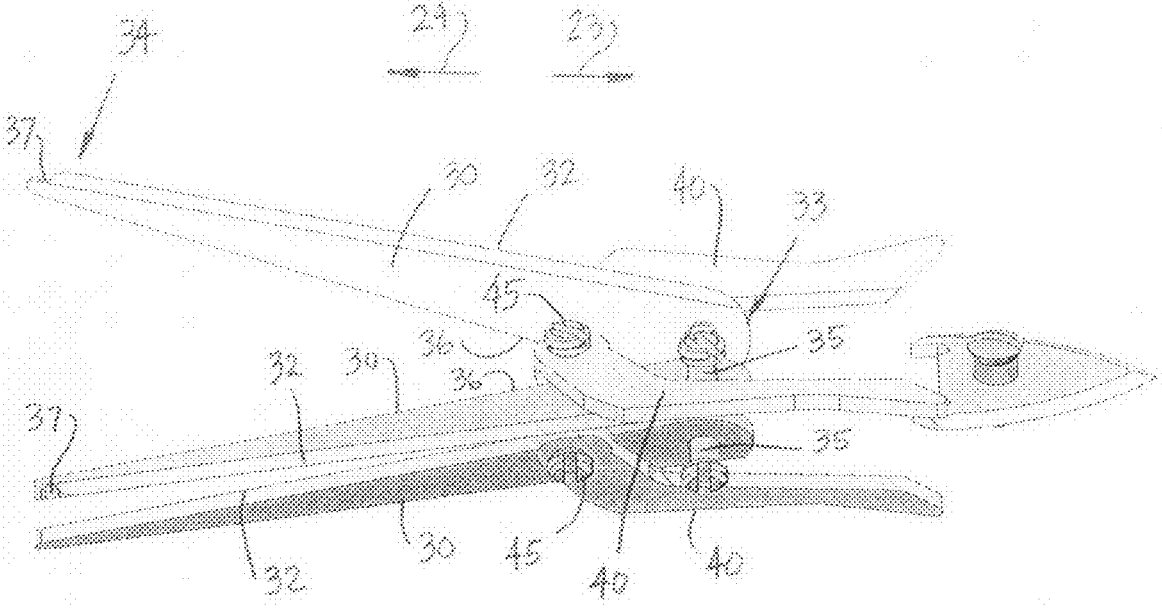
FIG. 6 is a perspective view of blade elements and actuation elements, according to one embodiment of this invention.

FIGS. 1-4 show forward direction 23 and rearward direction 24. As used throughout this specification and in the claims, forward direction 23 is a general direction that arrowhead 20 travels when in flight, and rearward direction 24 is in a direction generally opposite of forward direction 23. As shown in FIGS. 3, 4 and 6, in certain embodiments of this invention, leading end 33 of blade 30 is generally directed in forward direction 23, and trailing end 34 of blade 30 is generally directed in rearward direction 24.

In certain embodiment of this invention, blade 30 has cutting edge 32 directed or facing forward direction 23. Cutting edge 32 can be linear or non-linear. Cutting edge 32 can be positioned at any suitable angle with respect to longitudinal axis 21 of arrowhead 20.

As shown in FIGS. 1-4, actuation arm 40 comprises cutting edge 42. Cutting edge 42 can be linear or non-linear. Actuation arm 40 with cutting edge 42 can further enhance the overall cutting and/or penetrating capability of arrowhead 20. In other embodiments of this invention, actuation arm 40 can have a blunt or dull forward edge as part of or completely in place of cutting edge 42.

Figure 7:
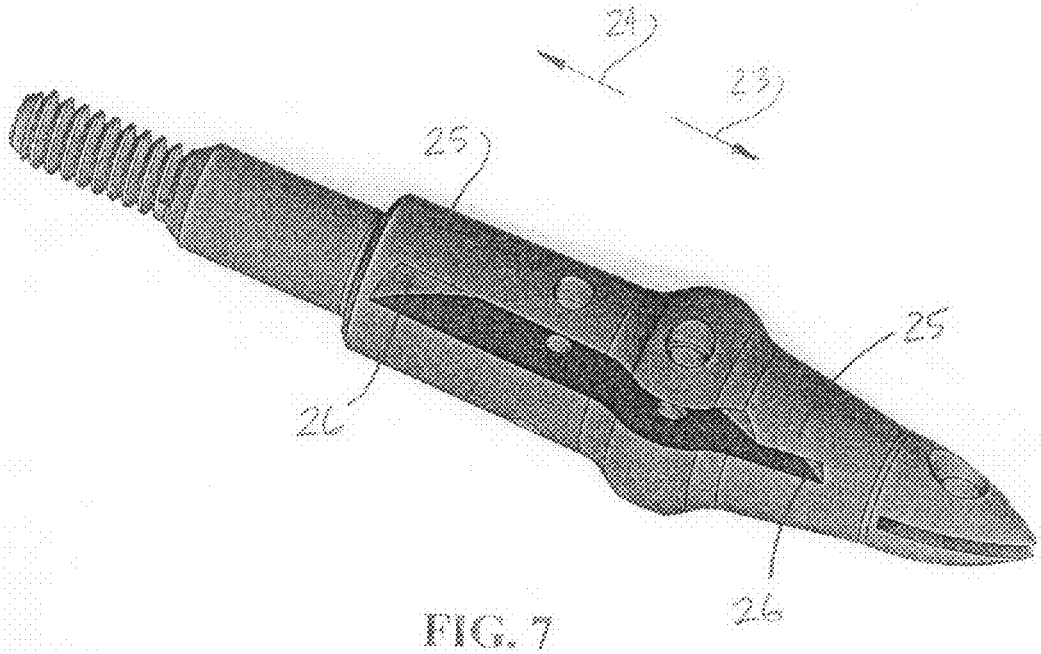
FIG. 7 is a perspective view of a body or a ferrule of an arrowhead, according to one embodiment of this invention.

FIGS. 3, 4 and 7 show body 25 having cut-away section 26. At least a portion of blade 30 is positioned within at least a portion of cut-away section 26. In some embodiments of this invention, each blade 30 can correspond to one cut-away section 26, such as shown in FIGS. 1-5. In other embodiments of this invention, two or more blades 30 can be positioned at least partially within one cut-away section 26.

As shown in FIGS. 1-5, each actuation arm 40 is at least partially positioned within one corresponding cut-away section 26. In other embodiments of this invention, two or more actuation arms 40 can be positioned at least partially within one cut-away section 26.

As shown in FIGS. 1-5, one blade 30 and one actuation arm 40 each is at least partially mounted within one corresponding cut-away section 26.

Figure 5:
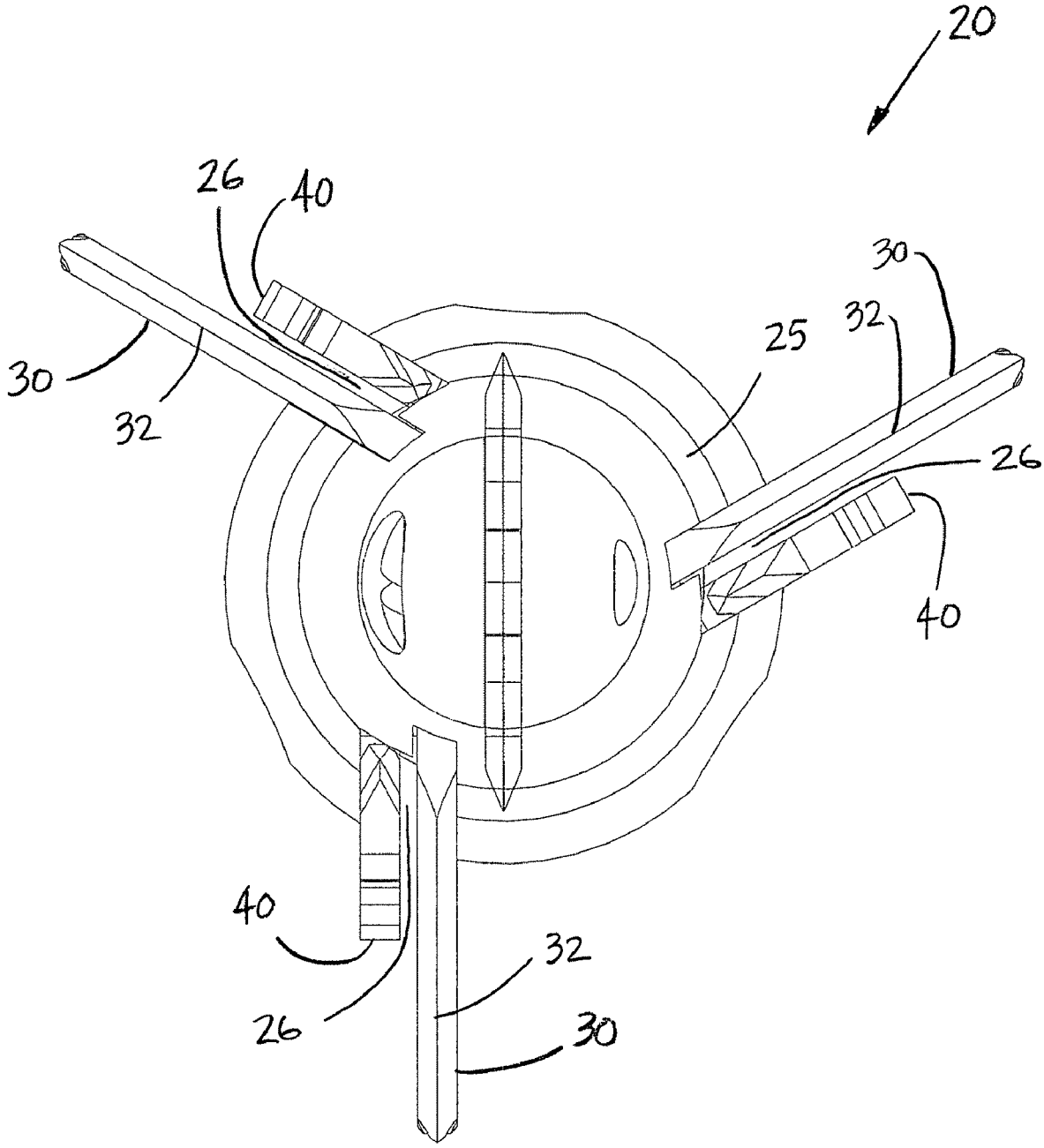
FIG. 5 is a front view of an arrowhead having three mechanical blades, according to one embodiment of this invention.

FIG. 5 shows three blades 30 and three actuation arms 40 each circumferentially spaced equally about a periphery of body 25. In certain embodiments of this invention, two or more blades are positioned at an equal distance about a periphery or a circumference of body 25. The position of each blade 30 and/or each actuation arm 40 can be selected to achieve a desired balance of arrowhead 20.

The relative positions of pivot axis 31 and pivot axis 41 can be changed to vary flight characteristics and/or cutting or penetration characteristics of arrowhead 20. In some embodiments of this invention, at least a portion of actuation arm 40 extends in forward direction 23 beyond or past pivot axis 31 of arm 30.

FIG. 3 shows pivot axis 31 of blade 30 positioned forward of pivot axis 41 of actuation arm 40. In other embodiments of this invention, pivot axis 41 can be positioned at a same location as pivot axis 31, or pivot 41 can be positioned forward of pivot axis 31. The design, shape and size of blade 30 and/or actuation arm 40, along with the desired movements, can dictate or govern the relative positions of pivot axis 31 and pivot axis 41.

In some embodiments according to this invention, as arrowhead 20 moves from the closed position to the open position, actuation arm 40 moves in rearward direction 24. During movement from the closed position to the open position, blade 30 preferably but not necessarily moves in rearward direction 24.

During movement from the closed position to the open position, in some embodiments of this invention, blade 30 moves away from body 25. Thus, distance 38 shown in the closed position of FIG. 3 increases to the greater distance 38 shown in FIG. 4. This type of movement, for example, can be used to increase the overall cutting radius of arrowhead 20. The length, other dimension and/or shape of blade 30 and/or actuation arm 40 can be varied to obtain different overall cutting radii of arrowhead 20.

As shown in FIGS. 3 and 4, a rearward portion of blade 30 contacts cam surface 51 in both the closed position and the open position. In the embodiment shown in FIG. 3, cam 50 is used as a stop element to limit or stop movement of blade 30 rearward and/or with respect to body 25. However, in the closed position and/or intermediate position between the closed position and the open position, it is not necessary for cam surface 51 to contact blade 30. As shown in FIG. 4, cam surface 51 contacts blade 30 to support blade 30 in the open position. Blade 30 can have blunt surface 36 contacting cam surface 51. In other embodiments of this invention, cam 50 can be used to move blade 30 into the open position and then any other suitable stop element or structure can be used to limit movement of blade 30 with respect to body 25, even without contact between surface 51 and blade 30.

As shown in FIGS. 3 and 4, blade 30 is pivotally mounted about shaft 35 and actuation arm 40 is pivotally mounted about shaft 45. Any other suitable movement and/or non-pivotal movement can be used to accomplish the movement of blade 30 away from body 25 as arrowhead 20 transitions or moves from the closed position to the open position.

Cam surface 51 can be fixed with respect to actuation arm 40, in certain embodiments of this invention. Cam 50 can be integrated with, mechanically coupled to and/or structurally arranged in any other suitable manner that results in cam 50 and thus cam surface 51 moving in response to movement and/or actuation of actuation arm 40 or another suitable actuator.

In some embodiments of this invention, blade 30 is normally urged into the closed position and/or in forward direction 23. Any suitable bias element, such as a spring, can be used to urge or force blade 30 into the closed position. As shown in FIG. 1, each blade 30 has recess 37 that can accommodate a rubber band or an O-ring or any other suitable mechanical, magnetic and/or electrical element that can be used to maintain blade 30 in the closed position, such as during flight of arrowhead 20. For example, Mizek, U.S. Pat. No. 6,398,676, the entire teachings of which are incorporated into this specification by reference, teaches leaf springs that can be used to normally urge or bias blade 30 into the closed position and/or in forward direction 23.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A blade-opening arrowhead, comprising:

a body, a blade pivotally mounted with respect to the body and moveable between a first position and a second position, an actuation arm pivotally mounted with respect to the body, a cam surface fixed with respect to the actuation arm, in said second position said cam surface contacting said blade, said blade having a cutting edge, in said first position said cutting edge having a forward end and a rearward end, and in said first position at least a portion of said actuation arm extending in a forward direction beyond said forward end.

2. The blade-opening arrowhead according to claim 1, wherein said actuation arm moves in a rearward direction from said forward end toward said rearward end as said blade moves from said first position to said second position.

3. The blade-opening arrowhead according to claim 1, wherein when moving from said first position to said second position a cutting edge of said blade moves away from said body.

4. The blade-opening arrowhead according to claim 3, wherein a distance from said cutting edge to said body is increased as said blade moves from said first position to said second position.

5. The blade-opening arrowhead according to claim 1, wherein a first pivot axis of said blade is positioned at one of at a forward location, at a rearward location and at a same location as a second pivot axis of said actuation arm.

6. The blade-opening arrowhead according to claim 1, wherein in said first position a forwardmost portion of said actuation arm is blunt.

7. A blade-opening arrowhead, comprising:

a body, a blade pivotally mounted with respect to the body and moveable between a first position and a second position, an actuation arm pivotally mounted with respect to the body, a cam surface fixed with respect to the actuation arm, in said second position said cam surface contacting said blade, and said actuation arm having a second cutting edge facing a same general direction as said first cutting edge of said blade.

8. The blade-opening arrowhead according to claim 7, wherein in said second position said actuation arm contacts said body and said blade contacts said cam surface.

9. The blade-opening arrowhead according to claim 7, wherein at least one of said blade and said actuation arm is pivotally mounted about a shaft that is fixed with respect to said body.

10. The blade-opening arrowhead according to claim 7, wherein said cam surface is integrated with said actuation arm.

11. The blade-opening arrowhead according to claim 7, wherein a cam forming said cam surface is fixed with respect to said actuation arm.

12. The blade-opening arrowhead according to claim 7, wherein said actuation arm is mechanically coupled to and moves said cam surface with respect to said blade.

13. The blade-opening arrowhead according to claim 7, wherein during movement between said first position and said second position a blunt surface of said blade follows movement of cam surface.

14. A blade-opening arrowhead, comprising:

a body, a blade pivotally mounted with respect to the body and moveable between a first position and a second position, an actuation arm pivotally mounted with respect to the body, a cam surface fixed with respect to the actuation arm, in said second position said cam surface contacting said blade, and said blade normally urged into said first position.

15. The blade-opening arrowhead according to claim 14, wherein a leaf spring is positioned to normally bias said blade into said first position.

* * * * *